US005526396A

United States Patent [19]

Jacob

[11] Patent Number: 5,526,396

[45] Date of Patent: Jun. 11, 1996

[54] ELECTRON TUBE WITH ADJUSTABLE CATHODE STRUCTURE

[75] Inventor: Heinz-Jürgen Jacob, Norderstedt, Germany

[73] Assignee: U.S. Philips Corporation, New York, N.Y.

[21] Appl. No.: 267,210

[22] Filed: Jul. 8, 1994

[30] Foreign Application Priority Data

Jul. 30, 1993 [DE] Germany ..... 43 25 609.0

[51] Int. Cl.[6] ..... H01J 35/06

[52] U.S. Cl. ..... 378/136; 378/135; 378/121

[58] Field of Search ..... 378/121, 119, 378/136, 137, 138; 313/271, 273, 274, 275, 276, 277, 278, 341, 344

[56] References Cited

U.S. PATENT DOCUMENTS

| | | | |
|---|---|---|---|
| 2,113,422 | 4/1938 | Coolidge | 250/35 |
| 2,123,607 | 7/1938 | Lee | 250/35 |
| 2,130,020 | 9/1938 | McEuen | 250/35 |
| 5,077,777 | 12/1991 | Daly | 378/136 |

FOREIGN PATENT DOCUMENTS

| | | | |
|---|---|---|---|
| 0273162 | 7/1988 | European Pat. Off. | H01J 35/14 |
| 63-105427 | 5/1988 | Japan | H01J 9/02 |

*Primary Examiner*—Don Wong
*Attorney, Agent, or Firm*—Robert J. Kraus

[57] ABSTRACT

An X-ray tube, comprising a cathode arrangement which includes an electron emitter connected to supporting pins which in turn are connected to the cathode structure via a respective fixing element. Particularly simple adjustment of the position of the filament is achieved in that the fixing elements are connected to the cathode structure in a first region and to the associated supporting pin in a second region which is remote from the first region, and that the fixing elements comprise a deformation zone between the first and the second region, deformation of said zone enabling adjustment of the position of the electron emitter relative to the cathode structure.

16 Claims, 2 Drawing Sheets

ELECTRON TUBE WITH ADJUSTABLE CATHODE STRUCTURE

BACKGROUND OF THE INVENTION

This invention relates to an electron tube, notably an X-ray tube, comprising a cathode arrangement which includes an electron emitter which is connected to supporting pins which in turn are each connected to the cathode arrangement via a respective fixing element.

An electron tube of this kind, that is to say an X-ray tube, is known from JP-A 63-105427. Therein, the electron emitter, being a directly heated filament, is first connected to a respective supporting pin at both its ends. The supporting pins are introduced into a respective hollow-cylindrical fixing element, the two fixing elements being embedded in a ceramic body. The unit thus formed is moved, by means of a positioning device, to a defined position relative to the cathode head and is fixed in this position.

In order to ensure a defined size and shape of the focal spot produced on the anode by the cathode, the electron emitter must occupy an accurately defined position relative to the focusing electrode even when the filament has been subjected to a thermal treatment. However, during such a thermal treatment the position of the filament may change, so that subsequent to a thermal treatment it is necessary to adjust the position of the electron emitter relative to the focusing electrode. Such adjustment requires skilled labour and is time consuming, notably when the thermal treatment and readjustment must be repeated.

In order to simplify the adjustment operations, EP-A 273 162 discloses the use of a two-part cathode head. Therein, the electron emitter or the supporting pins supporting it are first mounted in the one cathode part in which the filament is suitably accessible from the outside. The two cathode pans are joined only after execution of the thermal treatment and the adjustment.

During adjustment either the electron emitter or at least one of the pins supporting it is bent near its upper end until the electron emitter has reached the desired position.

SUMMARY OF THE INVENTION

It is an object of the present invention to construct an electron tube of the kind set forth so that the electron emitter can be quickly adjusted. This object is achieved in accordance with the invention in that the fixing elements are connected to the cathode arrangement in a first region and to the associated supporting pin in a second region which is remote from the first region, and that the fixing elements comprise a deformation zone between the first region and the second region, deformation of said deformation zone enabling adjustment of the position of the electron emitter relative to the cathode structure.

Thus, in accordance with the invention spatially remote regions of a fixing element are connected to a supporting pin on the one side and to the remainder of the cathode arrangement on the other side, a deformation zone being present between these regions. The electron emitter can be adjusted by deformation of this zone. Thus, the fixing element at the same time serves as an adjusting element.

The deformation of the deformation zone changes the relative position of the (first) region, in which the fixing element is connected to the cathode, and the (second) region in which the supporting pin is connected to the fixing element. Therefore, the electron emitter can be adjusted by deformation of the deformation zone, without it being necessary to bend the electron emitter (filament) or the supporting pins. This enables the use of already recrystallized filaments which are free of mechanical stress and which are, therefore, not deformed by heating in the operating condition. However, they are so brittle that they would break off during an adjustment operation where forces are exerted on the filaments.

Moreover, this enables the use of a one-part cathode head because free access to the filament or the electron emitter during adjustment is irrelevant.

In a preferred embodiment of the invention the fixing elements are formed as a sleeve in which a supporting pin can be introduced, the sleeve wall comprising a deformation zone in the form of a bulge. When a force acts on the bulge in a direction perpendicular to the sleeve, the diameter of the bulge decreases so that the supporting pin connected thereto is displaced in the one direction. A force acting on the bulge in the direction parallel to the sleeve direction deforms the bulge so that the supporting pin moves in the opposite direction.

In a preferred embodiment of the invention, the inner diameter of the sleeve is greater in the first region than the inner diameter of the sleeve in the second region which has been adapted to the outer diameter of the supporting pin. This makes it possible to change the position of the associated supporting pin, or the electron emitter connected thereto, by bending the fixing element, without bending the supporting pin itself or the electron emitter (filament). Moreover, the cathode arrangement can then be constructed so that the deformation zones on the side of the cathode which is remote from the electron emitter are accessible, so that adjustment is substantially facilitated. The same effect could be achieved by utilizing supporting pins whose outer diameter is greater in the (second) region, in which they are connected to the sleeve, than in the remainder of the supporting pin.

In an embodiment of the invention, the cathode arrangement comprises a cathode body of metal, at least one of the fixing elements being connected to the main body via a ceramic body. In this embodiment a one-pan main body of metal can be used without a ceramic plate. The ceramic body prevents electrical short-circuiting of the filament.

When a fixing element, and hence also the associated supporting pin or the electron emitter terminal connected thereto, is insulated relative to the cathode head, it is necessary to provide terminals via which a heating current can be applied. During soldering or welding of such a terminal, the already adjusted electron emitter is liable to be shifted again within the cathode structure. This risk can be avoided in a further embodiment in that the ceramic body is provided with a connection tag which is in electrical contact with the fixing element.

BRIEF DESCRIPTION OF THE DRAWING

The invention will be described in detail hereinafter with reference to the accompanying drawings, in which.

DESCRIPTION OF THE PREFERRED EMBODIMENTS

Figure 1:
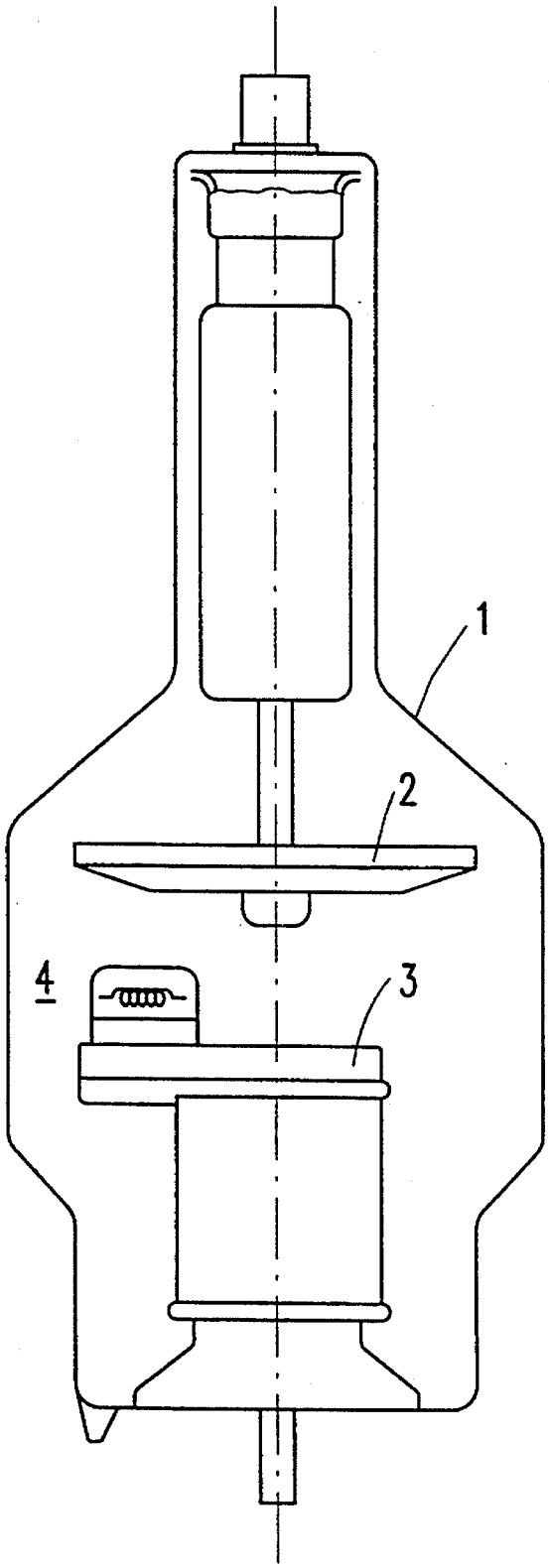
FIG. 1 shows an X-ray tube in which the invention can be used.

The rotary-anode X-ray tube shown in FIG. 1 comprises a glass tube envelope 1 which encloses a vacuum space in which are arranged a rotary-anode arrangement 2 and a cathode structure 3. The cathode structure comprises a cathode head 4 in which there is provided (only diagrammatically shown in FIG. 1) an electron emitter which is preferably a directly heated filament coil. The X-rays are thus generated by way of the electrons emitted due to the heating of the filament.

Figure 2:
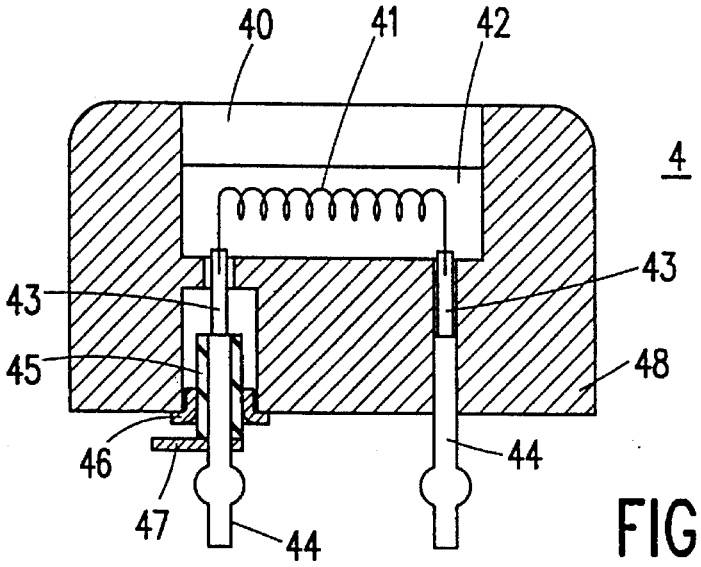
FIG. 2 is a sectional view of the cathode head of such an X-ray tube.

FIG. 2 is a cross-sectional view of the cathode head 4 taken in the longitudinal direction of the filament. The cathode head 4 comprises a main body 48 of metal, at the upper side of which there is provided a tub-like recess 40 in which a slit 42 opens, a filament 41 being accommodated in said slit. The two free filament limbs, which are bent so as to extend approximately at right angles to the filament, are connected to a respective supporting pin 43. The two supporting pins 43 consist of molybdenum and have a thickness of 1.5 mm. They penetrate a respective fixing element 44 and are connected to the end thereof. The fixing elements 44 are made of a metal having a suitable thermal expansion coefficient, for example, an alloy of iron, nickel and cobalt (Vacon) and are connected to the main body 48. However, whereas the right-hand fixing element 44 is connected directly to the main body 48, the left-hand fixing element 44 is connected to a ceramic body 45 which is connected to the main body 48 via a metal fixing ring 46.

Figures 3A, 3B, 3C:
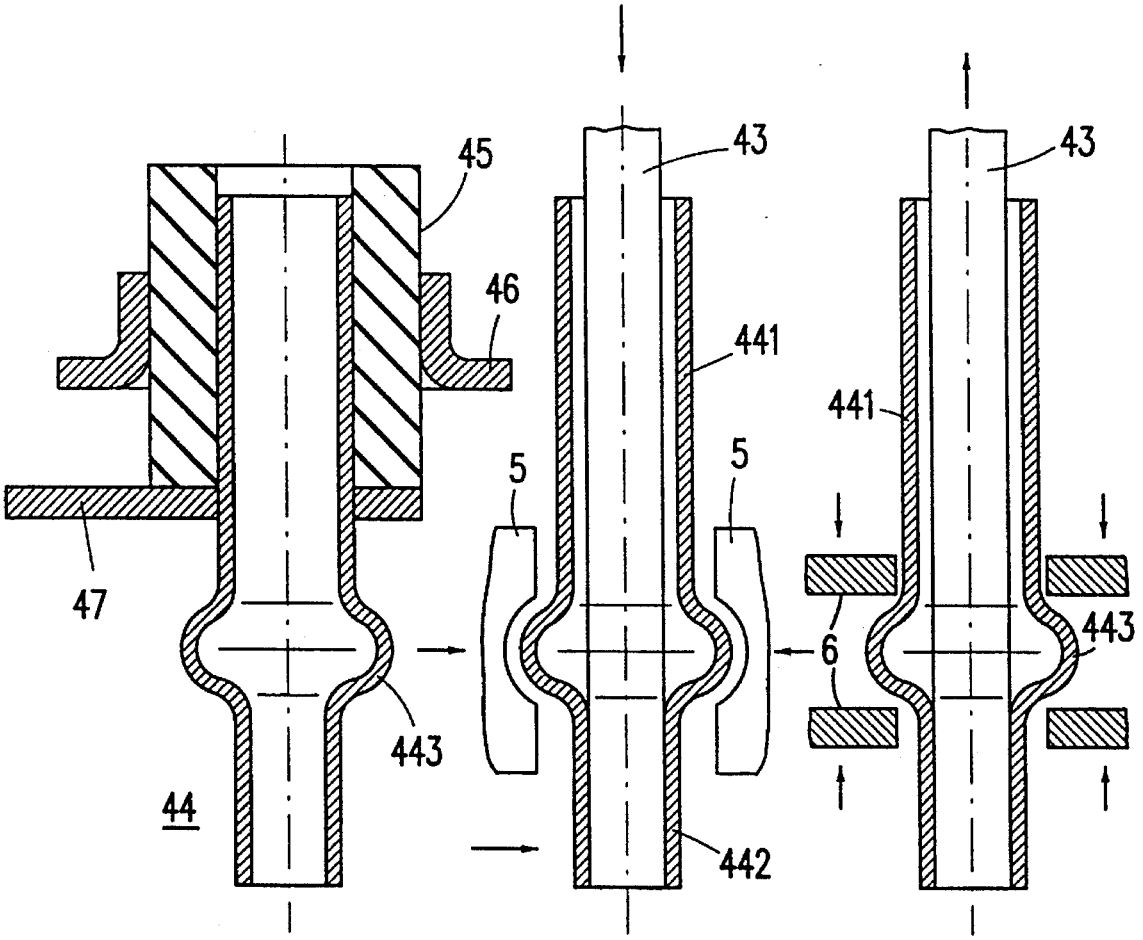
FIGS. 3*a* to 3*c* show the fixing element and the motions that can be performed thereby.

The appearance and the shape of the components 44 to 46 are shown specifically in FIG. 3*a*. The ceramic body 45 therein is shaped as a hollow cylinder. The upper end of the fixing element 44, penetrating the ceramic body 45, is soldered to the metallized inner surface of the ceramic body 45. The fixing ring 46, enclosing the ceramic body 45, is also soldered to the ceramic body 45 whose outer circumference is metallized at this area. A connection tag 47, connected to a lead for applying a filament current for the filament after assembly, is soldered to the metallized lower end face of the ceramic body 45, so that the connection tag 47 electrically contacts the fixing element 44 but not the fixing ring 46.

As appears from the FIGS. 3*b* and 3*c*, the fixing element 44 has a length of 12.5 mm and is shaped as a sleeve or a hollow cylinder having a wall thickness of 0.25 mm, its inner diameter amounting to 2.0 mm in an upper region (441) of a length of approximately 7 mm and to only 1.5 mm in a lower region (442), of a length of approximately 3 mm. The zone between these regions includes a deformable bulge 443 which is rotationally symmetrical relative to the longitudinal axis and whose outer diameter gradually increases to 4 mm, its wall thickness remaining constant. The supporting pin 43 penetrates the sleeve from the top and is connected to the sleeve at the area of its lower region 442.

The assembly of the cathode head 4 and the adjustment of the filament 41 will be described in detail hereinafter. First the fixing element 44, or the unit consisting of the fixing element and the components 45 . . . 47, is inserted into the one-part main body 48, is aligned, relative to the main body, by way of a suitable jig, and is connected thereto in a suitable manner, for example, by spot welding. The fixing elements 44 then occupy a defined position relative to the main body.

Furthermore, the filament 41 is connected to the two supporting pins 43 by spot welding. Use is preferably made of a filament which has been recrystallized as far as the area of its two lateral limbs by prior thermal treatment. The use of such a recrystallized coil offers the advantage that the filament is hardly deformed during a subsequent thermal treatment and later operation of the X-ray tube, and that the thermal treatment, requiring several change overs from heating to adjusting steps and vice versa when a non-recrystallized filament is used, can be substantially reduced. However, an already recrystallized filament is already so brittle that it breaks when it is bent during adjustment or when forces are applied to the filament by the bending of a supporting pin. Therefore, such filaments cannot be used in conjunction with the customary adjusting procedure.

Subsequently, the supporting pins 43 are inserted into the fixing elements 44 and moved to a defined position relative to the cathode head 48 by means of a suitable jig. They are fixed in this position in that they are connected to the fixing element 44 by spot welding at the area 442. The filament then occupies essentially the required position.

Subsequently, a finishing thermal treatment is applied to eliminate residual stresses, the filament then being heated in a hydrogen atmosphere in that a current is applied to the filament. The filament is thus completely recrystallized.

This operation is followed by exact adjustment of the filament by deformation of the deformable region formed by the bulge 443. The filament could be too high or too low, within the cathode head, on one or on both sides. It could be asymmetrically arranged relative to the slit 42, or have been rotated so that its individual turns are situated on a curved line.

If the position of the filament is too high, it can be adjusted by exerting a pressure on the bulge 443, using a tool (FIG. 3*b*) comprising jaws 5, in the direction perpendicular to the longitudinal axis of the fixing element 44, so that the bulge is slightly compressed. Because the upper region 441 of the fixing element is rigidly connected to the main body 48, the deformation moves the lower section 442 of the fixing element downwards, and hence also the supporting pin 43 or the end of the filament 41 connected thereto.

When the filament is situated too deep in the cathode head, use is made of a tool whose jaws 6 (FIG. 3*c*) which are situated above and below the bulge 443 are pressed together parallel to the longitudinal axis of the fixing element 44, so that the bulge is compressed more, the lower region 442 then approaching the upper region 441 so that the supporting pin 43 is moved upwards.

When it is necessary to move the filament laterally towards or away from a wall of the slit 42, the fixing element 442 can be bent by means of pliers acting on the lower region 44. The bulge 443 is then deformed and the supporting pin 43 is moved out of its concentric position within the upper region 441 without the supporting pin itself being bent.

Finally, the supporting pins can be rotated about their longitudinal axis by exerting a torsional moment on the lower region 442 of the fixing element by means of pliers. The filament can thus be rectilinearly aligned.

After the adjusting operation and before connection of the cathode head 4 to the remainder of the cathode arrangement 3, a terminal for power supply of the filament is soldered to the connection tag 47. The fixing element itself is not deformed thereby and its adjustment is not affected either.

The described adjusting operations can be carried out under direct visual control by the operator while using jigs which define the desired position of the filament. However, it is also possible to record the position of the filament within the cathode head by means of a suitable camera and to display it to the operator, after suitable image processing, on a monitor so that the adjusting operation is even further simplified and reduced.

For the described embodiment it was assumed that the electron emitter is formed by a filament to be directly heated.

However, other electron emitters, for example, indirectly heated electron emitters, can also be adjusted in this way.

I claim:

1. An electron tube comprising: a cathode arrangement which includes an electron emitter which is connected to supporting pins which in turn are connected to the cathode arrangement via a respective fixing element, wherein the fixing elements are connected to the cathode arrangement in a first region and to the associated supporting pin, in a second region which is remote from the first region, and wherein the fixing elements comprise a deformation zone located between the first region and the second region whereby deformation of said deformation zone enables adjustment of the position of the electron emitter relative to the cathode arrangement.

2. An electron tube as claimed in claim 1, wherein the fixing elements are formed as a sleeve which surrounds a supporting pin, the sleeve wall comprising a deformation zone in the form of a bulge.

3. An electron tube as claimed in claim 2, wherein the inner diameter of the sleeve is greater in the first region than in the second region.

4. An electron tube as claimed in claim 2, wherein the cathode arrangement comprises a main body of metal, at least one of the fixing elements being connected to the main body via a ceramic body.

5. An electron tube as claimed in claim 4, wherein the ceramic body includes a connection tag which is in electrical contact with the fixing element.

6. An X-ray tube comprising:

an anode structure, a cathode structure mounted in opposition to said anode structure and which includes;

an electron emitter connected to first and second support pins, first and second fixing elements to which are mounted said first and second support pins, respectively, wherein the first fixing element has a first region which is connected to a main body element of the cathode structure and a second region remote from the first region and which is connected to its first support pin, and the first fixing element further includes a deformation zone located between the first region and the second region and which is adapted to be deformed by a force applied thereto so as to adjust the position of the first support pin and hence the position of the electron emitter relative to the cathode structure.

7. The X-ray tube as claimed in claim 6 wherein the first fixing element comprises a sleeve in which said first support pin is mounted, the sleeve wall including the deformation zone which comprises a deformable bulge between the first and second regions which are located on opposite sides of the bulge.

8. The X-ray tube as claimed in claim 7 wherein the sleeve has an inner diameter in the first region which is greater than its inner diameter in the second region.

9. The X-ray tube as claimed in claim 8 wherein the outer periphery of the first support pin contacts the inner wall of the sleeve in the second region but is spaced apart from the inner wall of the sleeve in the first region.

10. The X-ray tube as claimed in claim 6 wherein the main body element of the cathode structure is made of metal and said first region of the fixing element is made of metal and is secured to said main body element via a ceramic element.

11. The X-ray tube as claimed in claim 10 further comprising an electrical connection element supported by the ceramic element so as to make electrical contact with a metal portion of said first region of the fixing element.

12. The X-ray tube as claimed in claim 6 wherein the second fixing element is mounted in an elongate opening in the main body element.

13. The X-ray tube as claimed in claim 7 wherein the sleeve has a uniform inner diameter and the part of the first support pin in the second region of the fixing element has a greater outer diameter than the part thereof in the first region of the fixing element whereby the outer periphery of the first support pin contacts the inner wall of the sleeve in the second region but is spaced apart from the inner wall of the sleeve in the first region.

14. The X-ray tube as claimed in claim 6 wherein said electron emitter comprises a recrystallized filament having a brittle characteristic.

15. The X-ray tube as claimed in claim 6 wherein the first fixing element comprises a sleeve in which said first support pin is mounted, the sleeve wall including a deformation zone which comprises a deformable bulge between the first and second regions, and the first support pin is dimensioned relative to the inner wall of the sleeve so that it is in contact therewith in the second region but is spaced apart therefrom in the first region whereby a force applied to the deformable bulge moves the second region relative to the first region in a manner such that the first support pin is moved to reposition the electron emitter without applying bending forces thereto.

16. The X-ray tube as claimed in claim 6 wherein the first fixing element comprises a sleeve in which said first support pin is mounted, the sleeve wall including a deformation zone located between the first and second regions, and the outer periphery of the first support pin contacts the inner wall of the sleeve in the second region but is spaced apart from the inner wall of the sleeve in the first region.

* * * * *